United States Patent [19]

Keller

[11] 4,141,692

[45] Feb. 27, 1979

[54] TAGGED FUEL COMPOSITIONS

[75] Inventor: James L. Keller, Fullerton, Calif.

[73] Assignee: Union Oil Company of California, Los Angeles, Calif.

[21] Appl. No.: 760,623

[22] Filed: Jan. 19, 1977

[51] Int. Cl.[2] ..... C10L 1/20

[52] U.S. Cl. ..... 44/59; 44/69; 44/79

[58] Field of Search ..... 44/59, 69, 79; 252/408

[56] References Cited

U.S. PATENT DOCUMENTS

| | | | |
|---|---|---|---|
| 1,666,693 | 4/1928 | Gaus | 44/69.1 |
| 2,068,635 | 1/1937 | Prutton | 44/79 |
| 2,281,598 | 5/1942 | Prutton | 44/79 |
| 2,364,921 | 12/1944 | Shokal | 44/69.1 |

*Primary Examiner*—Winston A. Douglas
*Assistant Examiner*—Y. Harris-Smith
*Attorney, Agent, or Firm*—Lannas S. Henderson; Richard C. Hartman; Dean Sandford

[57] ABSTRACT

Liquid fuels of readily identifiable origin contain extremely small quantities of certain types of chlorohydrocarbon or chlorocarbon tracers dissolved therein. The presence of such tracers is readily detected by gas chromatography, using a pulsed electron capture detector.

14 Claims, No Drawings

TAGGED FUEL COMPOSITIONS

BACKGROUND AND SUMMARY OF INVENTION

There are occasions when it is desirable to give gasoline or other fuels from a given source a distinctive characteristic, a "label", such that it can be identified and distinguished from any similar fuel from other sources. Some such occasions arise in cases of suspected theft from a storage location. Other occasions involve investigations of intended or unintended commingling of similar fuels from different sources, or investigations of the path or time delay in distribution of fuels, as from refinery to customer. Still other occasions arise when spills or leaks of fuel of uncertain origin result in contamination of earth or water.

For short term problems involving relatively small volumes of fuel, such as suspected theft or studies of fuel distribution, dye-type tracer products are available and may be satisfactory. These include oil-soluble dyes of distinctive color and other oil-soluble products which impart little or no color to the fuel but can be extracted with a test reagent to which they impart a distinctive color. Fuel containing phenolphthalein for example produces a pink color in the water layer when shaken with an aqueous alkaline solution. However such dye-type tracers are expensive and are generally undesirable for long term or continued use in fuels.

It would be desirable, particularly when fuel spills or leakage may occur, to have available an inexpensive tracer material which could be added to all the fuel from a given source (i.e., marketing station, refinery, or company) on a continuing basis, without giving unwanted side effects. Then if a spill or leak releases fuel of unknown origin, as when gasoline found percolating through the earth may have come from any of several underground tanks or pipelines in the vicinity, a test for tracer in the recovered fuel would determine its source.

In selecting a suitable tracer, several factors must be taken into consideration. Among the major ones are: cost, ease of detection, stability, solubility and compatibility with the fuel, inertness to air, water and normal soil components, corrosivity, volatility and toxicity. Balancing all of these factors against each other, and after surveying many other types of compounds, I have found that the chlorohydrocarbons and chlorocarbons having at least 3 chlorine atoms and at least 2 carbon atoms per molecule, and having an atomic ratio of Cl/C of at least $\frac{1}{3}$, appear to present an optimum combination of required properties.

Firstly, they are easily detectable in minute quantities by conventional gas chromatographic methods, using an electron capture detector. They can be selected according to boiling point so as to give a chromatogram peak readily distinguishable from the peaks resulting from other fuel components. Their boiling point can also be selected so as to fall within or above the upper $\frac{3}{4}$ of the boiling range of the fuel, thereby minimizing evaporative loss of tracer from spills or leaks. They are suitably inert to air, water and soil components, as well as conventional fuel components, and they are non-corrosive. They are relatively non-toxic, as compared to compounds such as $CCl_4$ and $CHCl_3$. Finally, a considerable variety of suitable members are commercially available at low cost. No other class of compounds is presently known which meets all these qualifications.

According to one often desirable modification of the invention, two or more of the tracer compounds may be used in combination, thereby providing a highly distinctive gas chromatogram.

DETAILED DESCRIPTION

Preferred tracer compounds for use herein contain from 3 to about 8 chlorine atoms and 2–10 carbon atoms per molecule, and have a Cl/C atomic ratio between 0.5 and 3. From the standpoint of gas chromatograph detectability, it is further preferred that at least 2 chlorine atoms per molecule be bonded to the same or adjacent carbon atoms, and/or that at least one chlorine atom, preferably at least 2, be bonded to an olefinic carbon atom. Exemplary preferred tracer compounds for gasolines are as follows:

TABLE 1

| | Boiling Pt., °C | Melting Pt., °C |
|---|---|---|
| 1. Trichloro ethylene | 87.2 | −73 |
| 2. 1,1,2-trichloro ethane | 113.5 | −37 |
| 3. Tetrachloro ethylene | 121 | −22 |
| 4. 1,1,2,2-tetrachloro ethane | 146 | −36 |
| 5. Pentachloro ethane | 162 | −29 |
| 6. Hexachloro ethane | 186 (777 mm) | 187 |
| 7. 1,2,4-trichloro benzene | 213 | 17 |
| 8. 1,2,4,5-tetrachloro benzene | 240–46 | 138–40 |
| 9. Pentachloro benzene | 275–77 | 85–6 |

The proportion of tracer to be employed depends mainly on its sensitivity to detection in the electron capture detector. Compounds which are highly sensitive, such as compounds 3 and 6 above, can be used in amounts as low as 0.01 mg/l, while less sensitive compounds such as 7 above can be used in amounts of 0.1 mg/l or more. In general, a wide range of concentrations can be utilized, from about 0.01 to 10 mg/l, but to insure against loss of detectability through aging or other factors while at the same time maintaining reasonable economy, the concentration range of about 0.2–4 mg/l is preferred.

Fuels to which the tracers may be applied include gasolines, both leaded and unleaded, diesel fuels, jet fuels, furnace oils, kerosenes and the like. In the case of leaded gasolines, a tracer should be selected that gives a chromatogram peak which can be differentiated from the peaks resulting from lead alkyls and the lead scavengers, ethylene dibromide and ethylene dichloride. Compounds 3 and 8 above are suitable for that purpose. In other fuels, the selection of a suitable tracer will depend mainly on the boiling range of the fuel, it being preferred to use a tracer boiling above or within the upper $\frac{3}{4}$ of the boiling range of the fuel. The chromatograms obtained herein from an electron capture detector seldom show hydrocarbon peaks which mask the tracer peak or peaks, and when such does occur, the problem is easily solved by selecting a different tracer compound, or by suitably modifying the chromatographic method so as to attenuate hydrocarbon peaks. Effective chromatographic separations for the present purposes can be obtained using either the polar or non-polar, boiling-range type of column.

In the following examples, the chromatograph method employed was as follows:

| Temperatures, °C. | | |
|---|---|---|
| Injection Port | : | 200 |
| Column | : | Programmed from 70 to 150° at 6°/min, or isothermal |

-continued

| Temperatures, ° C. | | |
|---|---|---|
| | | at 150°. |
| Detector | : | 220 |
| Carrier Gas | : | Nitrogen, ultra pure grade |
| Detector | : | Pulsed Electron Capture |
| Sample Size | : | 0.1 microliter |
| Column | : | 50' × .02" support-coated open tube, OV-101 boiling range stationary phase. |
| Syringe | : | Hamilton #7001 |

Gas flow over the sample injection port was 35 ml/min, but only 5 ml/min was passed through the column, the remainder being exhausted from the system in order to decrease the sample size. Make-up nitrogen was then added to the column effluent in order to provide the 35 ml/min flow required in the detector.

In all of the examples the fuel was commercial leaded gasoline containing 2.2–3.7 gm/gal of lead and about 2.0–3.4 gm/gal of combined ethylene dichloride and ethylene dibromide.

EXAMPLE I

In order to compare relative sensitivities of several tracers, the above chromatographic method was applied to fuel samples containing 10 mg/l of each tracer, with the following results:

TABLE 2

| Tracer | Sensitivity, mv/mg | Retention Time in Column, min. |
|---|---|---|
| 1. Trichloro ethylene | 5 | 2 |
| 2. 1,1,2-trichloro ethane | -not detected- | |
| 3. Tetrachloro ethylene | 12 | 4 |
| 4. 1,1,2,2-tetrachloro ethane | 0.9 | 5 |
| 5. Hexachloro ethane | 20 | 8 |
| 6. 1,2,4-trichloro benzene | 0.7 | 11 |
| 7. 1,2,4,5-tetrachloro benzene | 0.6 | 14 |

The failure to detect compound 2 is believed to be due to interference from the ethylene dibromide peak. This tracer is therefore probably not suitable for use in leaded gasolines.

EXAMPLE II

Three gasoline samples containing 0.5 mg/l of compound 8 above were treated as follows:

Sample A was extracted 5 times in succession with ½ its volume of water.

Sample B was similarly extracted with 1% $H_2SO_4$.

Sample C was similarly extracted with 1% aqueous NaOH solution.

Three other gasoline samples, E, F and G, each containing 1 mg/l of compound 3 were treated as were samples A, B and C respectively. Chromatographic analysis of the samples gave the following results:

Table 3

| Sample | Tracer | Treatment | Chromatogram Peak Height, mv |
|---|---|---|---|
| A | Tetrachloro benzene | Water ext. | 0.6 |
| B | " | 1% $H_2SO_4$ ext. | 0.6 |
| C | " | 1% NaOH ext. | 0.6 |
| D | " | None | 0.6 |
| E | Tetrachloro ethylene | Water ext. | 13 |
| F | " | 1% $H_2SO_4$ ext. | 13 |
| G | " | 1% NaOH ext. | 13 |
| H | " | None | 13 |

The foregoing demonstrates that the tracers are stable and are not measurably affected by acids or alkalis, and are detectable in extremely small quantities.

EXAMPLE III

Gasoline containing 0.5 mg/l of compound 8 was percolated through a 32 foot column of dry earth, and successive samples of effluent were analyzed. No tracer was detected in the first portion of effluent amounting to about 4% of the volume required to saturate the bed, but successive portions gave chromatogram peak heights (mv) of 1.1, 1.9, 1.6, 1.4 and 1.8 (for fractions amounting to 8%, 8%, 10%, 20% and 20% of the saturation volume, respectively), thus showing that the adsorptive capacity of earth for the tracer is very small. The same experiment repeated with gasoline containing 1 mg/l of compound 3 (tetrachloro ethylene) gave an initial tracer-free effluent amounting to 10% of the volume required to saturate the bed, but succeeding 10% fractions showed substantially the original content of tracer.

The following claims and their obvious equivalents are believed to define the true scope of the invention.

I claim:

1. A liquid hydrocarbon fuel composition containing dissolved therein at least about 0.01 but no more than about 10 mg/l of a chlorinated hydrocarbon component consisting essentially of at least one chlorohydrocarbon or chlorocarbon containing at least 3 chlorine atoms and at least 2 carbon atoms per molecule, and having a Cl/C atomic ratio of at least ⅓, said chlorinated hydrocarbon component being further selected to give an electron capture detector gas chromatogram peak distinguishable from the chromatogram peaks produced by all other components of said fuel, thereby forming a readily detectable tracer for said fuel.

2. A composition as defined in claim 1 wherein said fuel is an unleaded gasoline.

3. A composition as defined in claim 1 wherein said fuel is a leaded gasoline containing ethylene dichloride and/or ethylene dibromide as a lead scavenger.

4. A composition as defined in claim 1 wherein said fuel contains about 0.2–4 mg/l of said chlorinated hydrocarbon component.

5. A composition as defined in claim 1 wherein said chlorinated hydrocarbon component comprises tetrachloro ethylene.

6. A composition as defined in claim 1 wherein said chlorinated hydrocarbon component comprises 2 or more chlorohydrocarbons and/or chlorocarbons as defined therein.

7. A composition as defined in claim 1 wherein said chlorinated hydrocarbon component has a boiling point above or within the top ¾ of the boiling range of said fuel.

8. A liquid hydrocarbon fuel composition containing dissolved therein at least about 0.01 but no more than about 10 mg/l of a chlorinated hydrocarbon component consisting essentially of at least one chlorohydrocarbon or chlorocarbon having from 3 to about 8 chlorine atoms and 2–10 carbon atoms per molecule, and having a Cl/C atomic ratio between 0.5 and 3, at least 2 of said chlorine atoms per molecule being bonded to the same or adjacent carbon atoms, said chlorinated hydrocarbon component being further selected to give an electron capture detector gas chromatogram peak distinguishable from the chromatogram peaks produced by all other components of said fuel, thereby forming a readily detectable tracer for said fuel.

9. A composition as defined in claim 8 wherein said fuel is an unleaded gasoline.

10. A composition as defined in claim 8 wherein said fuel is a leaded gasoline containing ethylene dichloride and/or ethylene dibromide as a lead scavenger.

11. A composition as defined in claim 8 wherein said fuel contains about 0.2–4 mg/l of said chlorinated hydrocarbon component.

12. A composition as defined in claim 8 wherein said tracer component comprises tetrachloro ethylene.

13. A composition as defined in claim 8 wherein said chlorinated hydrocarbon component comprises 2 or more chlorohydrocarbons and/or chlorocarbons as defined therein.

14. A composition as defined in claim 8 wherein said chlorinated hydrocarbon component has a boiling point above or within the top $\frac{3}{4}$ of the boiling range of said fuel.

* * * * *